United States Patent [19]

Derderian

[11] Patent Number: 4,625,336

[45] Date of Patent: Dec. 2, 1986

[54] ATHLETIC GARMENT

[75] Inventor: Thomas Derderian, Portland, Oreg.

[73] Assignee: Nike, Inc., Beaverton, Oreg.

[21] Appl. No.: 739,120

[22] Filed: May 30, 1985

[51] Int. Cl.[4] ..... A41D 1/06

[52] U.S. Cl. ..... 2/79; 2/227; 2/409; 2/239

[58] Field of Search ..... 2/79, 80, 78 R, 78 B, 2/78 C, 227, 239, 409, 408, 2 R, 22

[56] References Cited

U.S. PATENT DOCUMENTS

| | | | |
|---|---|---|---|
| 2,604 | 2/1889 | Brown . | |
| 854,763 | 5/1907 | Scriven | 2/78 C |
| 1,249,446 | 12/1917 | Mell . | |
| 1,277,074 | 8/1918 | Hitzemann | 2/78 C |
| 1,329,025 | 1/1920 | Smith . | |
| 1,638,592 | 8/1927 | Monheimer | 2/78 C |
| 1,657,094 | 1/1928 | Rutledge | 2/78 C |
| 1,897,619 | 10/1931 | Powell . | |
| 2,352,128 | 6/1944 | Shikles, Jr. | 2/78 C |
| 2,664,570 | 1/1954 | Artzt | 2/78 C |

FOREIGN PATENT DOCUMENTS

| | | |
|---|---|---|
| 702435 | 1/1965 | Canada . |
| 2227411 | 1/1973 | Fed. Rep. of Germany . |
| 1357782 | 5/1964 | France . |
| 2344239 | 3/1976 | France . |
| 2309164 | 11/1976 | France . |
| 2498059 | 1/1981 | France . |
| 440164 | 1/1936 | United Kingdom . |
| 1266927 | 3/1972 | United Kingdom . |

OTHER PUBLICATIONS

Union Special Sewing Machine Brochure.

*Primary Examiner*—H. Hampton Hunter

*Attorney, Agent, or Firm*—Banner, Birch, McKie & Beckett

[57] ABSTRACT

The present invention relates to athletic garments and, in particular, to tight, form-fitting athletic garment with panels to simultaneously warm preselected small, fragile muscles and tendons and provide ventilation for preselected large, hard-working and heat-generating muscles. In a preferred embodiment, the garment is a runner's tight with relatively open mesh panels covering the quadraceps and calf muscles and tightly knit panels covering the hamstring muscles, the front of the leg, the achilles tendons region and the groin area. The open mesh panels and the knit panels are preferably joined at their adjacent edges by relatively broad, four-needle flat seams which provide a proprioceptive effect.

12 Claims, 6 Drawing Figures

ATHLETIC GARMENT

TECHNICAL FIELD

The present invention relates to athletic garments, and, in particular, tight, form-fitting athletic garments with two different type fabric panels to both warm the small, fragile muscles and tendons and provide ventilation for the large, hard-working and heat-generating muscles. The fabric panels are joined at their adjacent edges by relatively broad, four-needle flat seams to provide a proprioceptive effect.

BACKGROUND OF THE INVENTION

Athletic garments of the prior art teach using multiple materials to simultaneously warm and cool selected parts of the body. United Kingdom Pat. No. 440,164, owned by the Gesellschaft Co., discloses improvements in stockings including plating work of warmth conserving material designed to cover parts of the leg which are sensitive to cold, such as the knee and the adjoining portion of the thigh. However, the heat-insulating portions are limited to such parts of the stocking which normally remain invisible during wear.

United Kingdom Pat. No. 2,604 to Brown discloses the placement of ventilation holes in underwear. The holes are placed in the arm pits of shirts or vests, or in the gussets or folk of drawers or pants. U.S. Pat. No. 1,329,025 to Smith also discloses an undergarment with different kinds of material. Portions of the garment corresponding to areas of the body usually well covered by outergarments are made of fabric that is a good conductor of heat, such as cotton. Other parts of the undergarment corresponding to areas of the body which are not as well protected by outergarments are made of fabric which is a poor conductor of heat, such as wool.

U.S. Pat. No. 1,249,446 to Mell discloses a heavy warm fabric, such as wool, combined with a lighter, softer fabric such as silk. The lighter material is in contact with the skin of the wearer, while the heavier material is disposed so as to protect certain predetermined portions of the body, without contact therewith.

None of the prior art discloses an athletic garment which simultaneously warms the small, fragile muscles and tendons while providing ventilation for the large, hard-working muscles. Nor does the prior art teach the incorporation of relatively broad seams, such as four-needle flat seams, to provide a proprioceptive effect. These are important improvements since otherwise athletes may sacrifice performance by overheating themselves by wearing a garment of all heavy weight fabric. Alternatively, an athlete who wears a garment of all loose-weave material risks a decrease in performance due to cold and/or cramped small, fragile muscles, tendons and the like.

SUMMARY OF THE INVENTION

The present invention is directed to a tight, form-fitting athletic garment. The garment includes first fabric panels of relatively open mesh material which cover preselected large, hard-working muscles allowing excess heat to escape. The garment also includes second fabric panels of relatively closed mesh material which cover preselected tendons and small, fragile muscles to provide warmth.

In another aspect of the present invention, relatively broad, four-needle flat seams join panels of a form-fitting garment to provide a proprioceptive effect.

In a preferred embodiment, the garment is a form-fitting runner's tight with open mesh panels covering the quadracep and calf muscles and tightly knit panels covering the hamstring muscles, the front of the leg, the achilles tendons region and the groin area. When the mesh panels and the knit panels are joined at their adjacent edges by four-needle flat seams, these seams move against the skin of the runner enabling the wearer to feel his own movements.

By utilizing an athletic garment construction of the present invention, the disadvantages of overheating the large, hard-working muscles or allowing the small, fragile muscles and tendons to become chilled are overcome. Simultaneously ventilating the large, hard-working muscles and warming the small, fragile muscles helps an athlete perform at his or her peak efficiency. Furthermore, it is believed that the broad seam's proprioceptive effect allow an athlete to make small, subconscious corrections to the athlete's movement, further aiding efficient performance.

Various advantages and features of novelty which characterize the invention are pointed out with particularity in the claims, annexed hereto, and forming a part of the invention. However, for a better understanding of the invention, its advantages, and objects obtained by its use, reference should be made to the drawings which form a further part hereof and to the accompanying descriptive manner in which there is illustrated and described preferred embodiments of the invention.

BRIEF DESCRIPTION OF THE INVENTION

DETAILED DESCRIPTION OF THE INVENTION

Figure 1:
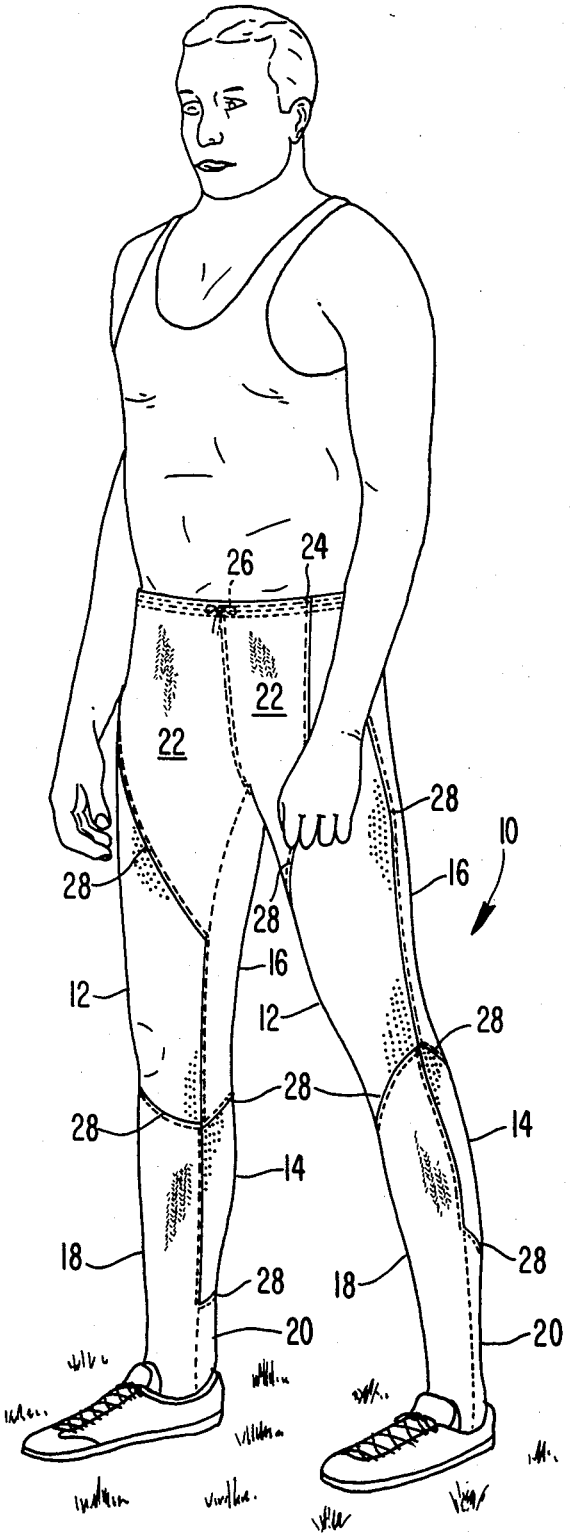
FIG. 1 is a frontal, oblique view of an athletic garment in accordance with the present invention worn by a person.
Figure 2:
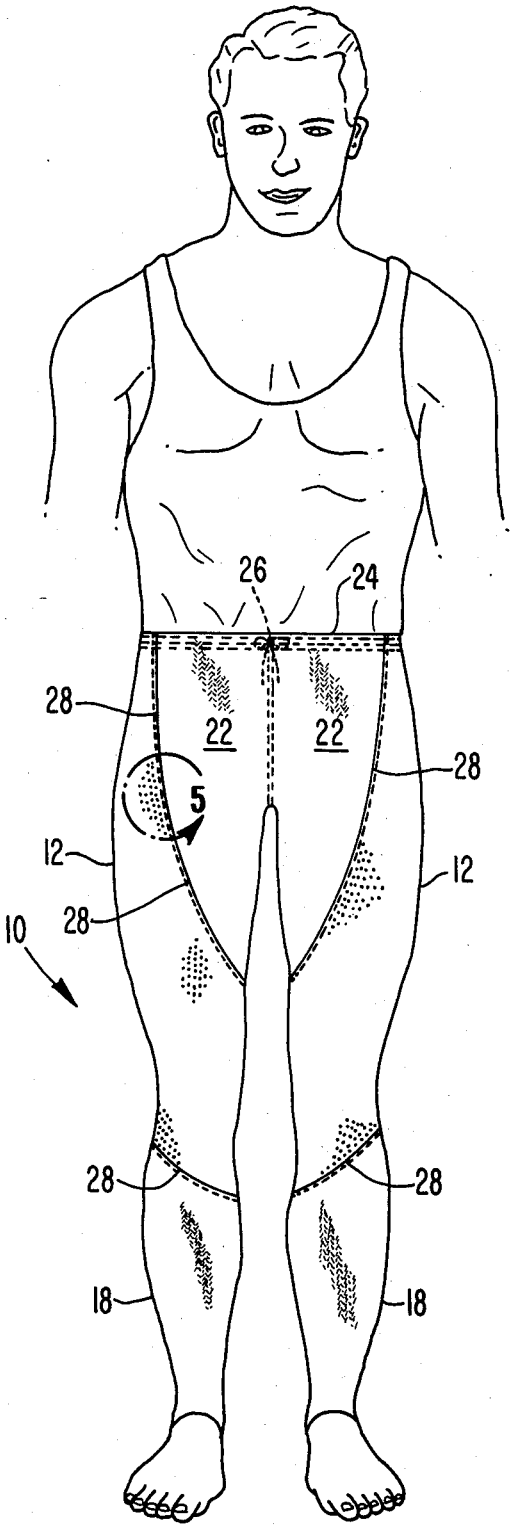
FIG. 2 is a frontal view of the worn garment.
Figure 3:
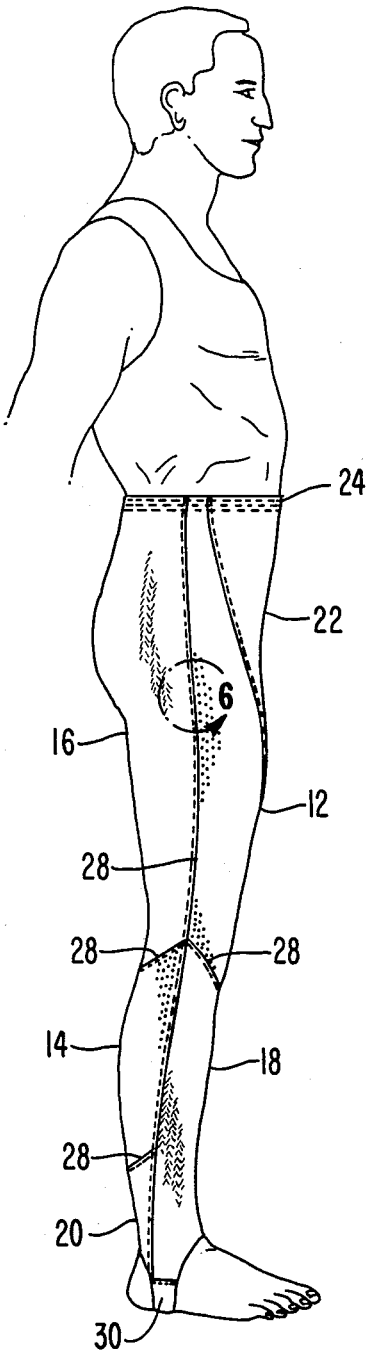
FIG. 3 is a side view of the worn garment.
Figure 4:
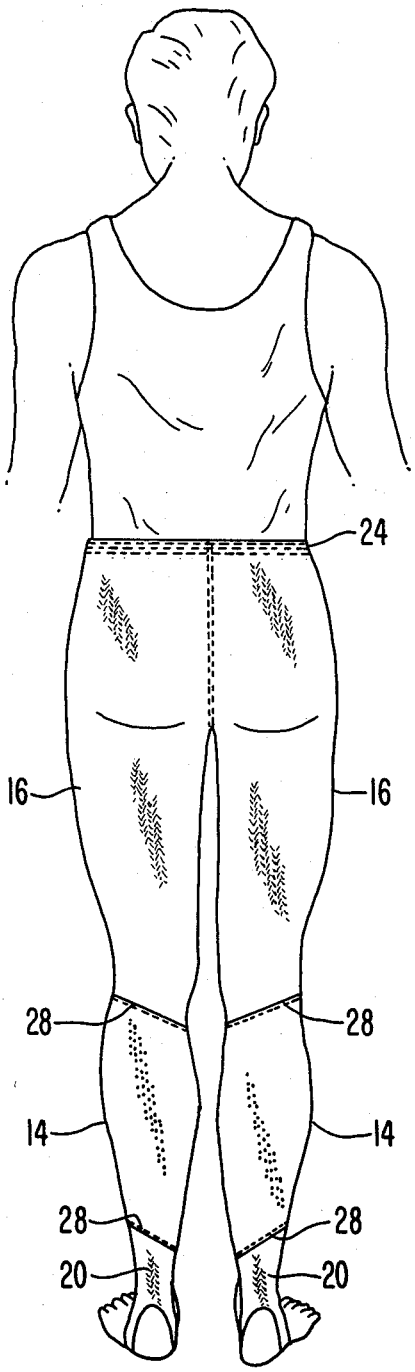
FIG. 4 is a rear view of the worn garment.

Referring to the drawings in detail, wherein like numerals indicate like elements, there is shown in FIGS. 1–4 an athletic garment of a preferred embodiment according to the present invention, designated generally as 10 and worn on a person. Garment 10 is tight and form-fitting and includes first fabric panels 12 and 14. Panels 12 extend from a waistband 24 to immediately below the knee to cover the quadracep muscles region. Panels 14 extend from immediately below the knee to just above the achilles tendons to cover the posterior calf muscles. First fabric panels 12 and 14 are made of a relatively open mesh material such as nylon lycra mesh. Panels 12 and 14 provide ventilation for the preselected large, hard-working muscles.

Athletic garment 10 also includes second fabric panels 16, 18, 20 and 22 made of a relatively closed mesh material, i.e., knit material such as knit spandex. As most clearly seen in FIG. 4, panels 16 extend on the posterior side from a waistband 24 to the upper edges of panels 14 immediately below the knee to cover the posterior thigh region including the hamstring muscles. Panels 18 extend from the lower edges of panels 12 immediately below the knee to the top of the foot to cover the anterior leg region including the extensor muscles. A stirrup 30, preferably constructed of the same material as panels 16, 18, 20 and 22, extends at the bottom of each leg of the tights from the medial side of the ankle bone, under the heel, to the lateral side of the ankle bone to secure the bottom edge of the tights at the foot. Panels 20 extend from the lower edges of panels 14 to just above the back of the heel to cover the achilles tendon region. Panels 22 extend from waistband 24, across the adductor muscles, to the upper edges of panels 12 at the quadracep muscles and to the medial edges of panels 16, to cover the groin area. Tightly knit panels 16, 18, 20 and 22 provide warmth to preselected small, fragile muscles and tendons.

Figure 5:
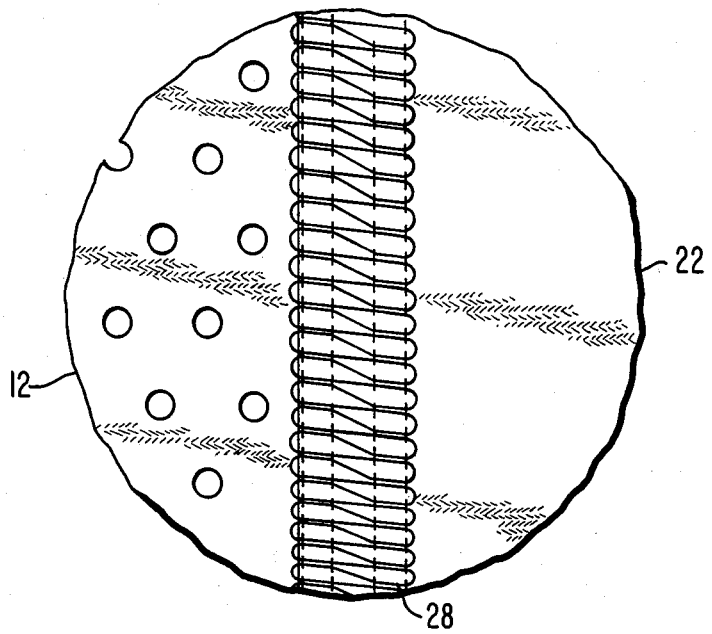
FIG. 5 is an enlarged sectional view of the portion of FIG. 2 encircled by line 5.
Figure 6:
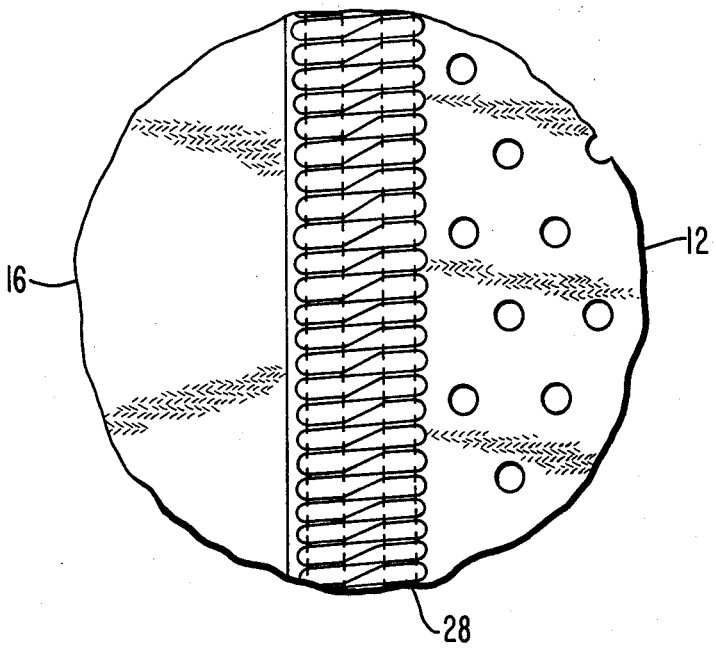
FIG. 6 is an enlarged sectional view of the portion of FIG. 3 encircled by line 6.

Waistband 24 is a casing within which is a drawstring 26. The open mesh panels and the knit panels are joined at their adjacent edges by seams 28. FIGS. 5 and 6 illustrate the seams in detail. The seams are relatively broad seams, preferably four-needle flat seams as made, for example, by a Union Special sewing machine, style 36200 AJ. The seams move against the skin of a performing athlete, creating a sensation that allows the wearer to feel his own movements. It is believed that this sensation allows the athlete to make reactive, unconscious adjustments to his muscular movements. This can add to the efficiency of work in a well-trained athlete. The flat, broad seams cause the sensation of movement providing the proprioceptive effect, without the irritation that overlock or surged seams create.

The present invention has been described as a runner's tight merely for illustrative purposes only and the invention includes other athletic garments of this construction. Numerous characteristics and advantages of the invention have been set forth in the foregoing description, together with details of the structure and function of the invention, and the novel features thereof are pointed out in the appended claims. The disclosure, however, being illustrative only, may be varied as to detail, especially in matters of shape, size and arrangement of parts, within the principles of the invention and to the full extent indicated by the broad general meaning of the terms in which the appended claims are expressed.

I claim:

1. A form-fitting athletic garment to simultaneously warm preselected tendons and fragile muscles while allowing excess heat to escape preselected large, hard-working muscles, comprising:

first fabric panels having relatively open mesh to cover preselected large, hard-working muscles;

second fabric panels having relatively closed mesh to cover preselected tendons and fragile muscles; and said first and second fabric panels being joined at their adjacent edges by seams so that the garment form-fits a wearer and said first fabric panels cover the preselected large, hard-working muscles and the second fabric panels cover the preselected tendons and fragile muscles.

2. A form-fitting garment according to claim 1 wherein said first fabric panels extend substantially from the waist to immediately below the knee to cover the quadracep muscles and from immediately below the knee to just above the achilles tendons to cover the posterior calf muscles; and said second fabric panels extend substantially from the waist to immediately below the knee to cover the posterior thigh region including the hamstring muscles, from immediately below the knee to the top of the foot to cover the anterior leg including the extensor muscles, over the achilles tendon region, and from the waist across the adductor muscles to the quadracep muscles to cover the groin area.

3. A form-fitting garment according to claim 1 wherein said first fabric panels ar made of nylon mesh and said second fabric panels are made of a tight knit stretch material.

4. A form-fitting athletic tight to simultaneously warm preselected tendons and fragile muscles of a performing athlete while allowing excess heat to escape preselected large, hard-working muscles, comprising:

a waistband;

first fabric panels formed of relatively open-mesh material to cover preselected large, hard-working muscles of the legs;

second fabric panels formed of relatively tight knit material to cover preselected fragile muscles and tendons of the legs; and said first and second fabric panels being joined at their adjacent edges by seams so that the athletic tight form-fits the lower body of a wearer and said first fabric panels cover the preselected large, hard-working muscles and the second fabric panels cover the preselected tendons and fragile muscles.

5. A form-fitting athletic tight according to claim 4 wherein said first fabric panels are nylon lycra mesh and said second fabric panels are knit spandex.

6. A form-fitting athletic tight according to claim 4 wherein said waistband includes a drawstring.

7. A form-fitting athletic tight according to claim 4 wherein said first fabric panels extend substantially from said waistband to immediately below the knee to cover the quadracep muscles and from immediately below the knee to just above the achilles tendons to cover the posterior calf muscles; and said second fabric panels extend substantially from the waistband to immediately below the knee to cover the posterior thigh region including the hamstring muscles and from immediately below the knee to the top of the foot to cover the anterior leg including the extensor muscles, over the achilles tendon region, and from the waistband across the adductor muscles to the quadracep muscles to cover the groin area.

8. A form-fitting athletic tight according to claim 7 wherein said first fabric panels are nylon lycra mesh and said second fabric panels are knit spandex.

9. A form-fitting athletic tight according to claim 4 further comprising: a stirrup of knit material to secure the lower edge of each leg of the tight to the foot.

10. A form-fitting athletic tight according to claim 4 wherein said first and second fabric panels are joined at their adjacent edges by relatively broad flat seams which move against the skin of a performing athlete enabling the wearer to feel his own movements.

11. A tight, form-fitting athletic garment providing a proprioceptive function comprising:

separate fabric panels for covering predetermined muscle and tendon groups of an athlete in a tight, form-fitting manner; and said separate fabric panels joined at their adjacent edges by relatively broad flat seams which move against the skin of a performing athlete enabling the wearer to feel his own movements.

12. A tight, form-fitting athletic garment according to claim 8 wherein said separate fabric panels comprise:

lightweight mesh panels to ventilate preselected large, hard-working muscles; and tightly knit panels to warm preselected tendons and fragile muscles.

* * * * *